United States Patent [19]

Kusano et al.

[11] Patent Number: 4,897,663

[45] Date of Patent: Jan. 30, 1990

[54] HORN ANTENNA WITH A CHOKE SURFACE-WAVE STRUCTURE ON THE OUTER SURFACE THEREOF

[75] Inventors: Mitsuhiro Kusano; Kazuo Kosukegawa; Kazuhiko Kurokawa, all of Tokyo, Japan

[73] Assignee: NEC Corporation, Tokyo, Japan

[21] Appl. No.: 945,979

[22] Filed: Dec. 24, 1986

[30] Foreign Application Priority Data

Dec. 25, 1985 [JP] Japan ..... 60-290777
Feb. 27, 1986 [JP] Japan ..... 61-42486

[51] Int. Cl.[4] ..... H01Q 13/02
[52] U.S. Cl. ..... 343/786
[58] Field of Search ..... 343/771, 772, 786, 841

[56] References Cited

U.S. PATENT DOCUMENTS

| | | | |
|---|---|---|---|
| 3,413,642 | 11/1968 | Cook | 343/786 |
| 3,611,396 | 10/1971 | Jones, Jr. | 343/786 |
| 4,414,516 | 11/1983 | Howard | 343/786 |
| 4,442,437 | 4/1984 | Chu et al. | 343/786 |
| 4,447,811 | 5/1984 | Hamid | 343/786 |
| 4,604,627 | 8/1986 | Saad et al. | 343/786 |
| 4,626,863 | 12/1986 | Knop et al. | 343/781 P |

FOREIGN PATENT DOCUMENTS

| | | | |
|---|---|---|---|
| 0127261 | 10/1979 | Japan | 343/786 |
| 0029202 | 2/1983 | Japan | 343/772 |
| 0183802 | 9/1985 | Japan | 343/786 |
| 2105914 | 3/1983 | United Kingdom | 343/772 |

*Primary Examiner*—J. Carroll
*Assistant Examiner*—Doris J. Johnson
*Attorney, Agent, or Firm*—Sughrue, Mion, Zinn, Macpeak & Seas

[57] ABSTRACT

A horn antenna for radiating or receiving a microwave is provided with a plurality of axially spaced radial fins fixedly mounted on the outer surface of the horn, which fins form a plurality of radial grooves and a front axial groove each having a depth of approximately equal to a quarter of a wavelength of the microwave. Those fins and grooves form a choke surface-wave structure which improves the radiation pattern and reduces undesired radiation and side lobe. A multimode horn arrangement for a higher frequency wave is employed for the horn so that two different frequency waves are efficiently radiated or received at a single horn antenna with a reduced side lobe and an excellent cross polarization characteristic.

7 Claims, 6 Drawing Sheets

HORN ANTENNA WITH A CHOKE SURFACE-WAVE STRUCTURE ON THE OUTER SURFACE THEREOF

BACKGROUND OF THE INVENTION (1) Field of the Invention

The present invention relates to horn antennas and parabolic antenna systems using the horn antenna and, in particular, to improvements in the horn antennas.

(2) Description of the Prior Art

A horn antenna is usually used for radiating or receiving a microwave. The horn antenna is sometimes used alone and is otherwise used together with a parabolic reflector to form a parabolic antenna system.

A known type of horn antenna is a circular waveguide type having a circular cylindrical shape.

In this connection, the term "cylindrical" should not be restricted to having an element of "circle" but should be understood to include having an element of "circle," "ellipse," "rectangle" and "other closed loop." Therefore, in the present specification including the description and claims, the term "cylindrical" should be understood to mean "having a shape determined by a closed surface circumferentially extending around a central axis and being in parallel with the central axis".

As well known in the prior art, the radiation pattern characteristic of the waveguide horn antenna is determined by a transmission mode of the horn, which usually is the dominant mode or $TE_{11}$ mode of the circular waveguide horn. Since the dominant $TE_{11}$ mode is asymmetric about the central axis of the horn, the radiation pattern of the horn antenna is disadvantageously asymmetric about the central axis.

In use of the circular waveguide horn together with a parabolic reflector to form a parabolic antenna system, the asymmetric radiation characteristic results in reduced radiation efficiency of the system and in deteriorated cross polarization waves.

U.S. Pat. No. 3,212,096 by D. M. Schuster et al discloses another horn antenna which comprises a waveguide horn and a ground plane being mounted at the horn aperture and having a choke surface-wave structure on the front surface of the ground plane. The radiation pattern of the horn antenna is approximately symmetric about the central axis due to provision of the choke surface-wave structure on the ground plane, and the side lobe is also reduced because undesired current induced on the outer surface of the horn is reduced due to the ground plane.

However, the use of the ground plane having the choke surface-wave structure disadvantageously results in an increased radial dimension of the horn antenna.

Another horn antenna is also well known in the prior art wherein grooves or recesses, which are generally termed corrugations, are formed in the inner surface of the horn. However, it is very difficult to form the corrugations in the inner surface of the horn as the choke surface-wave structure. Therefore, the horn having the inner corrugations is very expensive.

When the horn antenna is used as a primary radiator in a parabolic antenna system, the aperture of the parabolic reflector is blocked over an increased area by the primary radiator so that the antenna gain of the parabolic antenna system is reduced while the side lobe is increased.

Further, with respect to the known horn antennas, it is impossible to efficiently radiate or receive a plurality of waves of different frequencies by a single antenna.

SUMMARY OF THE INVENTION

Accordingly, it is an object of the present invention to provide a horn antenna having an approximately symmetric radiation pattern characteristic and a reduced side lobe with a reduced radial dimension of the antenna size.

It is another object of the present invention to provide a horn antenna which can efficiently radiate or receive two different frequency waves.

It is still another object of the present invention to provide a parabolic antenna system having an increased antenna gain and a reduced side lobe.

According to an aspect of the present invention, a horn antenna is obtained which comprises a horn of an electric conductive material with a cylindrical outer surface portion thereof and an aperture formed at a front end for radiating or receiving microwave energy of a given wavelength. The horn is provided with a plurality of annular conductive fins fixedly mounted at axially-spaced positions on the cylindrical outer surface portion thereof. The conductive fins generally radially extend in parallel with one another and define annular grooves between adjacent ones on the outer surface of the horn. Each annular groove has a depth generally equal to a quarter of the given wavelength.

These fins and grooves form a choke surface-wave structure on the cylindrical outer surface of the horn, which serves to make the radiation pattern of the antenna symmetric about the central axis and to reduce the side lobe level.

Since the horn antenna has a small radial dimension, a parabolic antenna system using the horn antenna as a primary radiator has an increased antenna gain and a reduced side lobe level.

According to another aspect of the present invention, a horn antenna for radiating or receiving two different lower and higher frequency waves is obtained which comprises a multimode horn and a choke surface-wave structure formed on the outer surface of the horn.

The multimode horn has an aperture at a front end and a cylindrical outer surface portion at the front side thereof. The multimode horn is formed to propagate a dominant or $TE_{11}$ mode and a higher mode for the higher frequency wave so that the dominant mode and the higher mode are in-phase with each other at the aperture of the horn. The multimode horn is also formed to propagate only a dominant or $TE_{11}$ mode without any higher modes for the lower frequency wave.

The choke surface-wave structure comprises a plurality of axially spaced annular radial conductive fins being fixedly mounted on the cylindrical outer surface portion of the horn. The conductive fins generally radially extend in the parallel with one another and define annular grooves between adjacent ones on the cylindrical surface portion. Each annular groove has a depth generally equal to a quarter of a wavelength of the lower frequency wave.

DETAILED DESCRIPTION OF PREFERRED EMBODIMENTS

Prior to a description of preferred embodiments of the present invention, known horn antennas will be described at first in order to facilitate an understanding of the present invention.

Figure 1A:
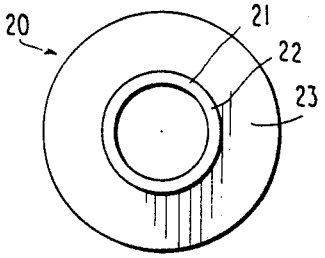
FIG 1a PRIOR ART
FIGS. 1*a* and 1*b* are a front view and a sectional view of a known circular waveguide horn antenna, respectively.
Figure 1B:
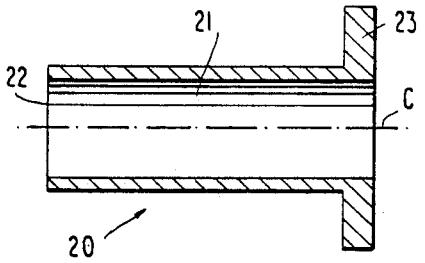
FIG 1b PRIOR ART

Referring to FIGS. 1*a* and 1*b*, a known circular waveguide type horn antenna 20 comprises a circular cylindrical horn 21 having an aperture 22 at a front end thereof. A circular radial flange 23 is mounted at an opposite or rear end of the horn 21.

A circular waveguide (not shown) is connected to the rear end of the horn 21 and jointed joined to the radial flange 23.

In operation, the wave guided through the waveguide and the horn 21 is radiated from the aperture 22.

Since the horn 21 and the waveguide connected thereto are usually designed so that a transmission mode of the guided wave is the dominant mode or $TE_{11}$ mode, the horn antenna 20 has a problem that the radiation pattern is asymmetric about the central axis C of the horn, as described above.

For radiating or receiving a wave of a frequency $f_1$ by the horn antenna 20, the horn 21 is designed to have the dominant mode $TE_{11}$ for the frequency $f_1$ without generation of any higher mode. In use of the horn antenna for another wave of a higher frequency $f_2$ ($f_2 > f_1$), higher mode waves such as $TE_{21}$, $TM_{11}$ or others are also generated in addition to the dominant mode $TE_{11}$ for the frequency $f_2$. Generation of those higher mode waves deteriorates symmetry of the radiation pattern and increases side lobe, so that the radiation efficiency is lowered and the cross polarization waves are deteriorated. Therefore, the horn antenna 20 is improper for radiating or receiving a plurality of different frequency waves.

Figure 2A:
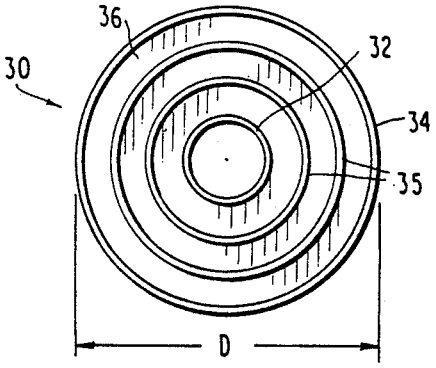
FIG. 2a PRIOR ART
FIGS. 2*a* and 2*b* are a front view and a partially sectional side view of another known horn antenna, respectively.
Figure 2B:
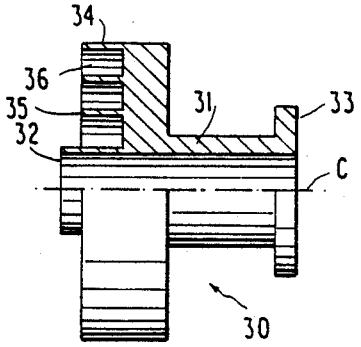
FIG. 2b PRIOR ART

Referring to FIGS. 2*a* and 2*b*, a horn antenna 30 shown therein is a type disclosed in the above-described U.S. Pat. No. 3,212,096. The horn antenna 30 comprises a circular waveguide horn 31 with an aperture 32 at a front end thereof and a circular radial flange 33 at a rear end similar to the horn 21 in FIGS. 1*a* and 1*b*.

A circular conductive plate 34 is mounted adjacent the aperture 32 of horn 31 and is provided with a choke surface-wave structure on the front surface thereof. The choke surface-wave structure comprises a plurality of concentric conductive rings 35 which are radially spaced from one another and fixed on the front surface of the plate 34. A plurality of concentric annular grooves 36 are therefore defined by the rings 35 on the plate 34. An axial length of each ring 35 is designed so that each groove 36 has a depth approximately equal to a quarter of a wavelength of an operating frequency of the horn antenna.

During the radiating operation of the antenna, those grooves 36 are excited by a wave radiated from the horn aperture 32. Accordingly, the radiation pattern of the antenna 30 is determined by not only an electromagnetic field distribution at the horn aperture 32 but also an electromagnetic field distribution at each groove 36, so that the radiation pattern of the horn antenna 30 becomes approximately symmetric about the central axis C in comparison with the horn antenna as shown in FIGS. 1*a* and 1*b*. Moreover, the side lobe is lowered by provision of the choke surface-wave structure as described previously.

However, a diameter D of the circular plate 34 is considerably larger than a diameter of the horn 31. Therefore, the horn antenna 30 has an increased radial dimension.

Further, the depth of each groove 36 cannot be designed for a plurality of radiating waves of different frequencies, but must be designed only for a single radiating wave. Therefore, the horn antenna 30 is also improper for use for radiating or receiving a plurality of different frequency waves.

The present inventors experimentally found out that the choke surface-wave structure need not necessary be formed in the radial ground plane, as seen in the prior art but can be formed on the outer cylindrical surface of the horn without use of the radial ground plane so as to improve the radiation pattern and the side lobe. It is needless to say that the choke surface-wave structure need not be formed on the inner surface of the horn, as corrugations of the type seen in the prior art.

The present invention is based on the newly acquired knowledge.

Figure 3A:
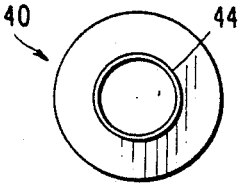
FIGS. 3*a* and 3*b* are a front view and a partially sectional side view of a horn antenna according to a first embodiment of the present invention, respectively.
Figure 3B:
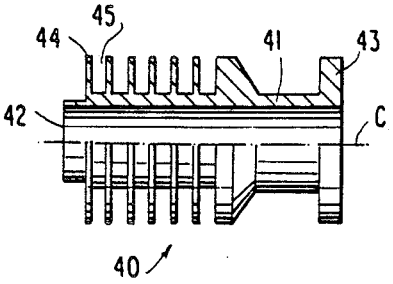

Referring to FIGS. 3*a* and 3*b*, a horn antenna 40 according to an embodiment of the present invention comprises a circular waveguide horn 41 with an aperture 42 at a front end. A connecting flange 43 is mounted at a rear end of the horn 41 for joining a waveguide (not shown) to the horn 41. The horn 41 is designed so that the transmission mode of the guided wave is the dominant mode or $TE_{11}$ mode.

A plurality of circular radial fins 44 are fixedly mounted on an outer surface of the horn 41 and axially spaced from one another. Those fins 44 radially extend from the outer surface of the horn 41 in parallel with one another by a distance approximately equal to a quarter of a wavelength (λ) of the guided wave, so that each two adjacent fins define a groove 45 with a depth of about λ/4 on the outer surface of the horn 41. Thus, a choke surface-wave structure is made on the outer surface of the horn 41 by provision of fins 44.

In operation, those grooves 45 are excited by a wave radiated from the horn aperture 42. The radiation pattern of the horn antenna 40 is determined by not only the electromagnetic field distribution at the horn aperture 42 but also the electromagnetic field distribution at each groove 45. Therefore, the radiation pattern is approximately symmetric about the central axis C of the horn 41.

Further, an undesired current flowing on the outer surface of the horn 41 is blocked by the choke surface-wave structure of fins 44. Accordingly, the undesired radiation is reduced and the side lobe level is also lowered.

The number of fins 44 is two at minimum, and more is desired for a better effect. The space between adjacent fins should be much less than the wavelength λ of the radiated wave, for example, λ/8−λ/5. The thickness of each fin should also be much less than the wavelength λ, for example λ/20 or less.

Figure 4A:
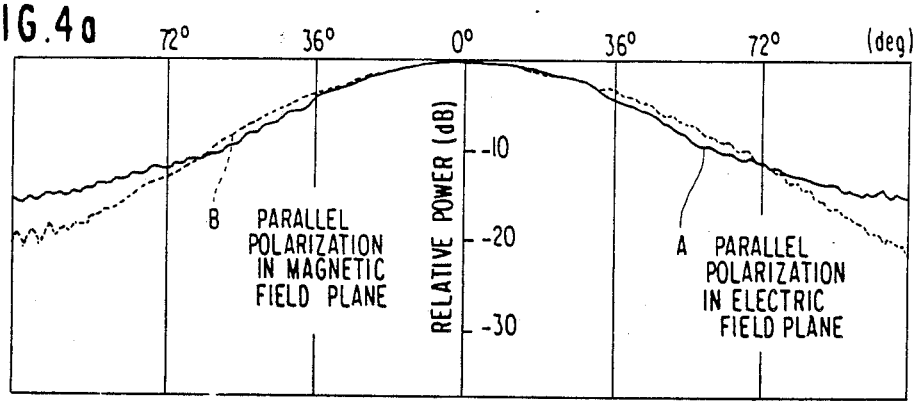
FIGS. 4*a* and 4*b* are graphical views illustrating radiation characteristics of a horn antenna according to the embodiment of FIGS. 3*a* and 3*b;*
Figure 4B:
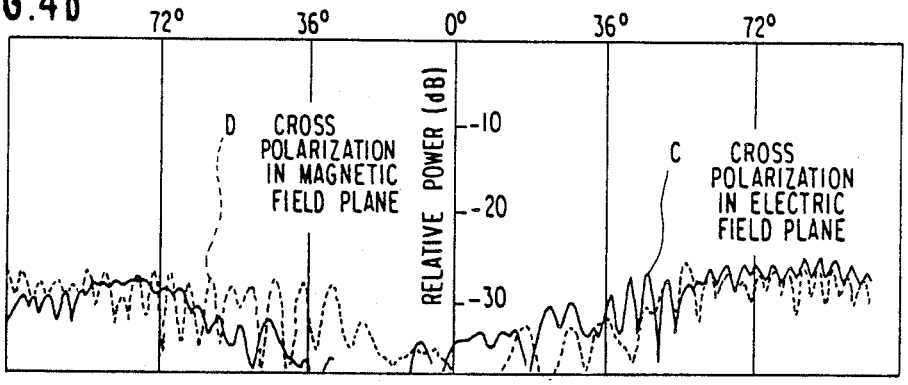

FIGS. 4*a* and 4*b* demonstrate radiation characteristic of a particular horn antenna arranged according to the embodiment of FIGS. 3*a* and 3*b*. The horn antenna has a horn aperture diameter of 0.7λ, a groove depth of λ/4 and four grooves (that is, five fins).

Referring to FIG. 4*a*, a curved solid line A and a curved dashed line B represents a parallel polarization characteristic in the electric field plane and in the magnetic field plane, respectively. A curved solid line C and a curved dashed line D in FIG. 4*b* shows a cross polarization characteristic in the electric field plane and in the magnetic field plane, respectively.

In comparison with a known horn antenna as shown in FIGS. 1*a* and 1*b* having the same horn aperture diameter, the particular horn antenna of the present embodiment was confirmed to be improved by about 3 dB in symmetry of the parallel polarized wave and by about 5 dB in the cross polarization waves.

Referring to FIGS. 3*a* and 3*b* again, the horn antenna 40 is provided with fins 44 around the waveguide horn 41. Each fin radially extends by only a distance approximately λ/4. Therefore, the radial dimension of the horn antenna 40 is quite small in comparison with the known horn antenna 30 having the choke surface-wave structure in FIGS. 2*a* and 2*b*. Therefore, the horn antenna of FIGS. 4*a* and 4*b* is preferably used for a primary radiator in a parabolic antenna system because blocking of the wave reflected from a parabolic reflector is reduced in comparison with the horn antenna of FIGS. 2*a* and 2*b*.

Figure 5A:
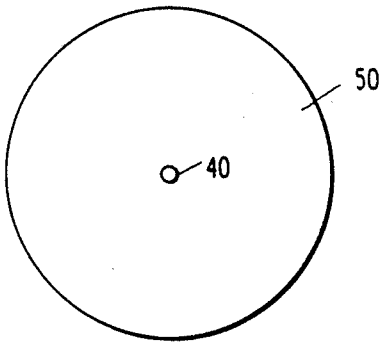
FIGS. 5*a* and 5*b* are a front view and a side view of a parabolic antenna system using the horn antenna in FIGS. 3*a* and 3*b;*
Figure 5B:
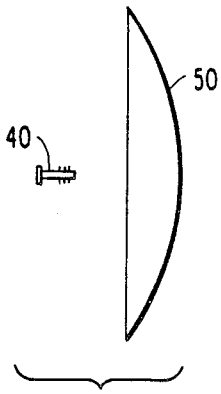

Referring to FIGS. 5*a* and 5*b*, the horn antenna 40 of FIGS. 3*a* and 3*b* is disposed at a focus of a parabolic reflector 50, to thereby form a parabolic antenna system. The wave radiated from the horn antenna 40 is reflected by the reflector 50. The reflected wave is radiated into space with a reduced interference from the horn antenna 40 because the radial dimension of the horn antenna 40 is small.

Figure 6A:
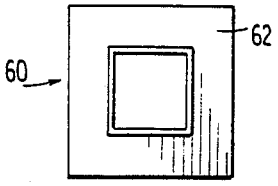
FIGS. 6*a* and 6*b* are a front view and a partially sectional siee view of a horn antenna according to a second embodiment, respectively.
Figure 6B:
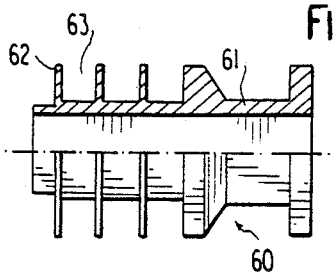
Figure 7A:
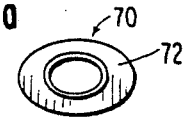
FIGS. 7*a* and 7*b* are a front view and a partially sectional side view of a third embodiment, respectively.
Figure 7B:
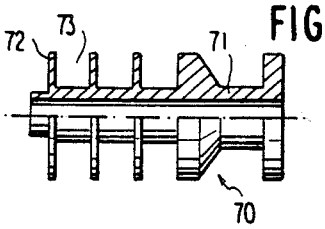

The present invention may be constructed with not only the circular layout in FIGS. 3*a* and 3*b* but also a rectangular layout as shown in FIGS. 6*a* and 6*b* as well as an elliptic layout as shown in FIGS. 7*a* and 7*b*.

Referring to FIGS. 6*a* and 6*b*, a horn antenna 60 shown therein uses a rectangular horn 61. A plurality of rectangular fins 62 is fixedly mounted on an outer surface of the horn 61 and is axially spaced from one another in the similar manner as in FIGS. 3*a* and 3*b*. Each adjacent fin 62 forms a groove 63 with a depth of λ/4 therebetween on the outer surface of the rectangular horn 61.

Referring to FIGS. 7*a* and 7*b*, a horn antenna 70 comprises an elliptic horn 71 and a plurality of elliptic fins 72. These fins 72 are mounted on the outer surface of horn 71 in a similar manner as in FIGS. 3*a* and 3*b*. Grooves 73 with a depth of λ/4 are formed between adjacent fins on the outer surface of the horn 71.

Figure 8A:
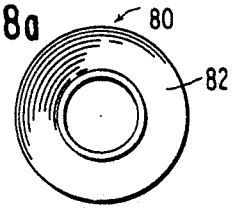
FIGS. 8*a* and 8*b* are a front view and a partially sectional side view of a fourth embodiment, respectively.
Figure 8B:
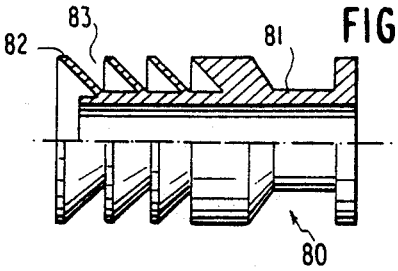

Referring to FIGS. 8*a* and 8*b*, a horn antenna 80 of a fourth embodiment is a modification of the first embodiment of FIGS. 3*a* and 3*b*. The horn antenna 80 comprises a circular waveguide horn 81 and a plurality of fins 82 fixedly mounted on the outer surface of the horn 81 to define grooves 83.

In this embodiment, each fin 82 is inclined frontwardly, that is, formed in a funnel shape opening toward the horn aperture.

Similarly, the radiation pattern is insured approximately symmetrical similar to the first embodiment of FIGS. 3*a* and 3*b*, but the radiation pattern of the parallel polarized waves can be modified according to the inclined angle of the fin 82.

Those horn antennas 60, 70, and 80 can be also used for a primary radiator in a parabolic antenna system in the similar manner as shown in FIGS. 5*a* and 5*b*.

Figure 9A:
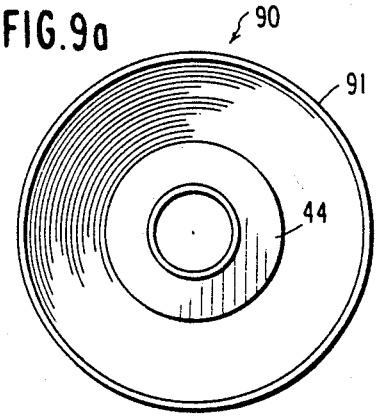
FIGS. 9*a* and 9*b* are a front view and a partially sectional side view of a fifth embodiment, respectively.
Figure 9B:
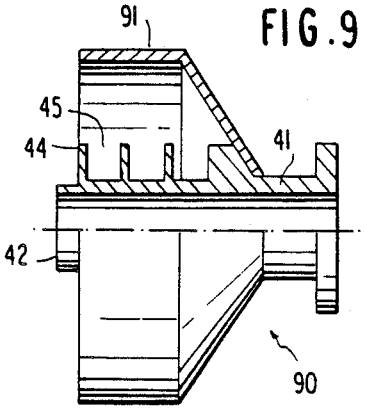

Referring to FIGS. 9*a* and 9*b*, a horn antenna 90 is characterized by an electromagnetic shielding member 91 mounted on the horn antenna shown in FIGS. 3*a* and 3*b*. Similar parts are represented by the same reference numerals.

The shielding member 91 is in a funnel shape having an inner hollow space, and is fixedly mounted on the horn 41. The funnel shape shielding member 91 is open frontwardly and encloses fins 44 within the inner hollow space.

The shielding member 91 serves to further reduce undesired backward radiation.

Figure 10A:
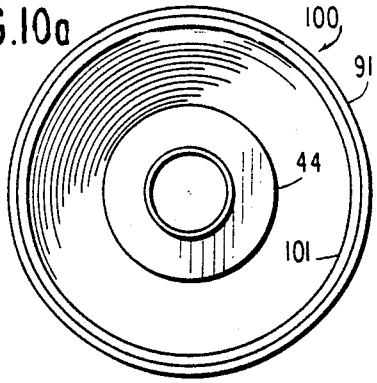
FIGS. 10*a* and 10*b* are a front view and a partially sectional side view of a sixth embodiment, respectively.
Figure 10B:
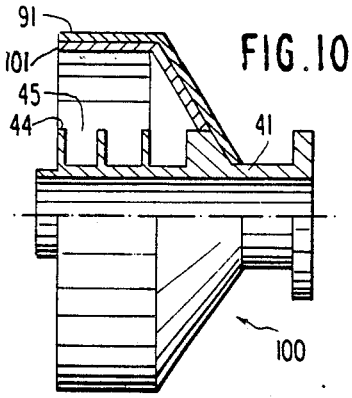

Referring to FIGS. 10*a* and 10*b*, a horn antenna 100 of a sixth embodiment is a modification of the embodiment of FIGS. 9*a* and 9*b*, and is characterized by a wave absorber layer 101 coated on an inner surface of the shielding member 91. A rubber based ferrite can be used for the wave absorber layer 101. The undesired radiation can be further reduced by the use of the wave absorber.

These shielding member and wave absorber can be applied to horn antennas shown in FIGS. 5*a*–7*b* and also to horn antennas in FIGS. 11*a*, 11*b*, and 13–16 as described hereinafter.

The use of the shielding member increases a radial dimension of the horn antenna, and therefore, increases blocking of a wave reflected by a parabolic reflector. However, since the horn antenna having the shielding member has an improved radiation pattern and a reduced side lobe level, it can be advantageously used for a primary radiator in a so-called offset type parabolic antenna system, wherein a primary radiator is disposed at a position not to block the wave radiated from the reflector.

Figure 11A:
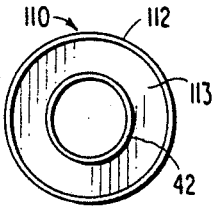
FIGS. 11*a* and 11*b* are a front view and a partially sectional side view of a seventh embodiment, respectively.
Figure 11B:
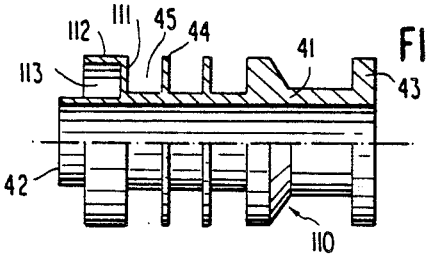

Referring to FIGS. 11*a* and 11*b*, a horn antenna 110 of a seventh embodiment is also a modification of the first embodiment of FIGS. 3*a* and 3*b*. Similar parts are represented by the same reference numerals in FIGS. 3*a* and 3*b*.

In this embodiment, a front side one of the fins 44, which is denoted by 111, is provided with an annular flange 112 on the radial peripheral end. The annular flange 112 axially extends frontwardly from the radial end of the fin 111 by a distance equal to about $\lambda/4$, so that an annular groove 113 is defined by the outer surface of the horn 41, the fin 111, and the flange 112. The groove 113 is open frontwardly and has an axial depth of about $\lambda/4$.

Figure 12A:
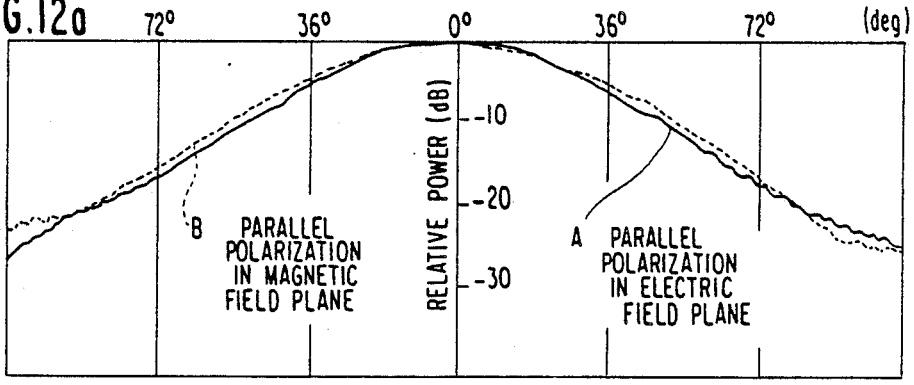
FIGS. 12*a* and 12*b* are graphical views illustrating radiation characteristics of the horn antenna of FIGS. 11*a* and 11*b;*
Figure 12B:
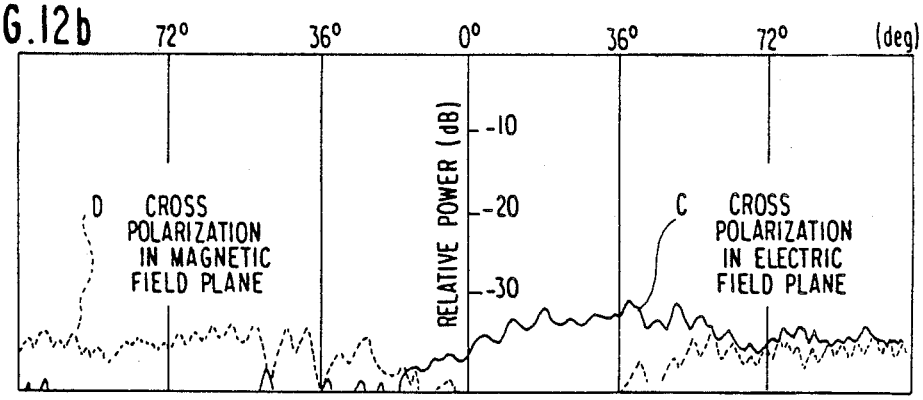

A radiation characteristic of the horn antenna 110 is actually measured and is demonstrated in FIGS. 12*a* and 12*b*.

Referring to FIG. 12*a*, a curved solid line A shows a parallel polarization characteristic in the electric field plane, and a curved dashed line B shows a parallel polarization characteristic in the magnetic field plane. FIG. 12*b* shows cross polarization characteristics in the electric field plane and the magnetic field plane by a solid line C and a dashed line D, respectively.

For comparison, a similar radiation characteristic was also measured for a baseline horn antenna having only the axial groove 113 without radial grooves 45. As a results, it was confirmed that the horn antenna 110 of this embodiment is superior to the baseline antenna by 1.5 dB in the symmetry of the radiation pattern and by 5 dB in the cross polarization waves.

In the above-described embodiments, the present invention has been described in connection with a horn having a constant cross section over its axial length. However, it is also possible to improve the radiation pattern and the side lobe of a flare type horn enlarging frontwardly by providing the choke surface-wave structure on the outer surface of the flare type horn.

The above-described horn antennas 40–110 cannot efficiently radiate or receive two different frequency waves, by the same reason as described hereinbefore in connection with the known antenna of FIGS. 1*a*–2*b*.

Figure 13A:
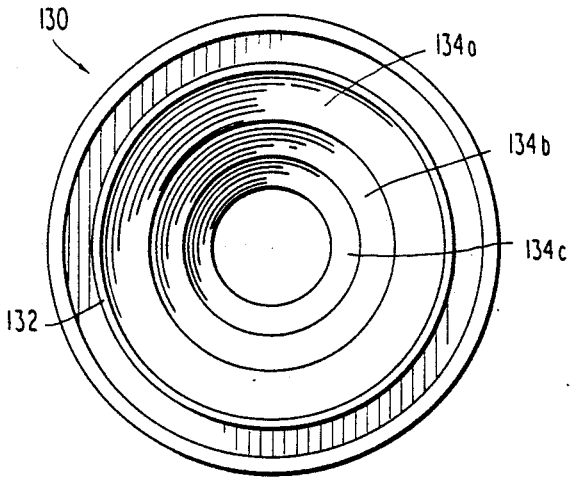
FIGS. 13*a* and 13*b* are a front view and a partially sectional side view and a partially sectional side view of an eighth embodiment, respectively.
Figure 13B:
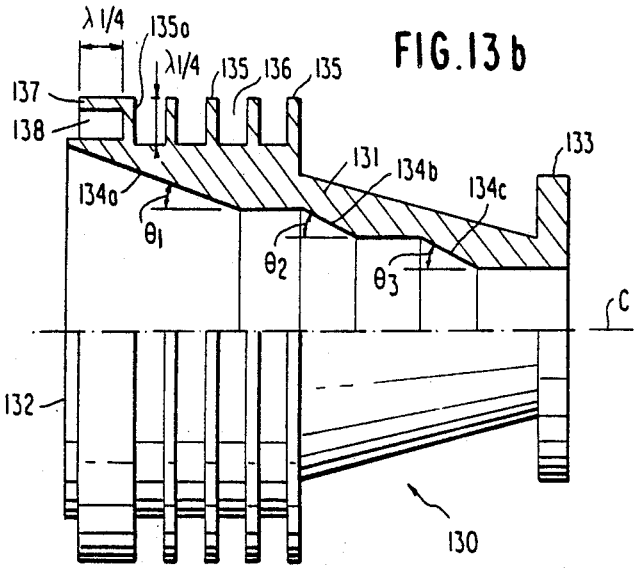

An eighth embodiment is illustrated in FIGS. 13*a* and 13*b* as a horn antenna which can be advantageously used for radiating or receiving two different frequency waves.

Referring to FIGS. 13*a* and 13*b*, the horn antenna 130 shown therein comprises a horn 131 having an aperture 132 at a front end. The horn 131 is provided with a radial flange 133 at a rear end for joining thereto a waveguide (not shown) connected to the horn 131.

Two different frequency waves ($f_1$ and $f_2$) are guided through the waveguide and the horn 131, and are radiated in the space from the aperture 132.

The horn 131 is designed so that only the $TE_{11}$ mode wave is propagated without higher mode for a lower frequency ($f_1$) wave and that the $TE_{11}$ mode wave and a higher mode, for example, $TM_{11}$ mode wave are propagated and are in phase with each other at the aperture 132 for the other higher frequency ($f_2$) wave. This is realized by employment of a multimode horn arrangement.

In this embodiment, a multiflare arrangement is used. That is, the inner surface of the horn 131 is formed with a plurality of tapers (three tapers are shown at 134*a*, 134*b*, and 134*c*) axially spaced from one another. The above-described requirement for design of the horn is achieved by selecting taper angles $\theta_1-\theta_3$, axial lengths, and axial spaces of tapers 134*a*–134*c*.

The horn 131 is provided with a cylindrical outer surface portion at the front side thereof, on which a plurality of radial fins 135 are fixedly mounted, as shown in FIG. 13*b*. These fins are axially spaced from one another to form a plurality of radial grooves 136 on the outer surface of the horn 131 in the similar manner as the above-described first to seventh embodiments. Each groove has a depth approximately equal to a quarter of a wavelength ($\lambda_1$) of the lower frequency ($f_1$) wave.

A front side fin 135*a* is provided with an annular flange 137 on the outer peripheral end, which axially extends frontwardly. Thus, an axial groove 138 is formed by the annular flange 137, fin 135*a*, and the outer surface of horn 131. The axial groove 138 is open frontwardly and has an axial depth of about $\lambda_1/4$.

These axial and radial grooves 138 and 135 form the choke surface wave structure for the lower frequency ($f_1$) wave.

It will be noted that the axial groove 138 can be omitted by deleting the annular flange 137 to form a similar choke surface-wave structure as shown in FIG. 3*b*.

In operation, only dominant mode or $TE_{11}$ mode wave is radiated from the aperture 132 for the lower frequency ($f_1$) wave. However, the radiation pattern is approximately symmetric with the central axis C and undesired radiation is blocked by the effect of the choke surface-wave structure in a similar manner as described in connection with the embodiment of FIGS. 3*a* and 3*b*.

For the higher frequency ($f_2$) wave, $TE_{11}$ mode wave and $TM_{11}$ mode wave are in-phase with each other at the aperture 132. Therefore, the higher frequency wave is radiated from the aperture 132 with symmetric radiation pattern about the central axis C and with a reduced side lobe level.

Thus, the horn antenna 130 can be used for radiating or receiving two different frequency waves.

Further, the horn antenna 130 has a small radial size and therefore, can be used as a primary radiator in a parabolic antenna system in a similar manner as shown in FIGS. 5*a* and 5*b*. Thus, a parabolic antenna system for radiating or receiving two different frequency waves can be obtained with a small blocking of waves reflected by the parabolic reflector.

Figure 14:
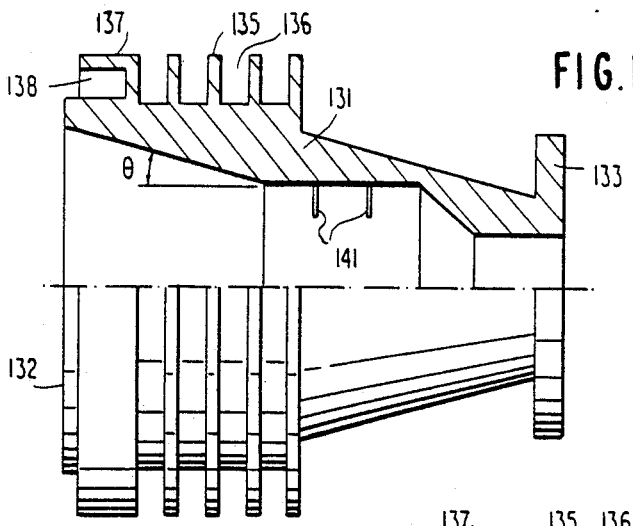
FIGS. 14–16 are views for illustrating modifications of a horn antenna of FIGS. 13*a* and 13*b*, with use of different multimode arrangements.
Figure 15:
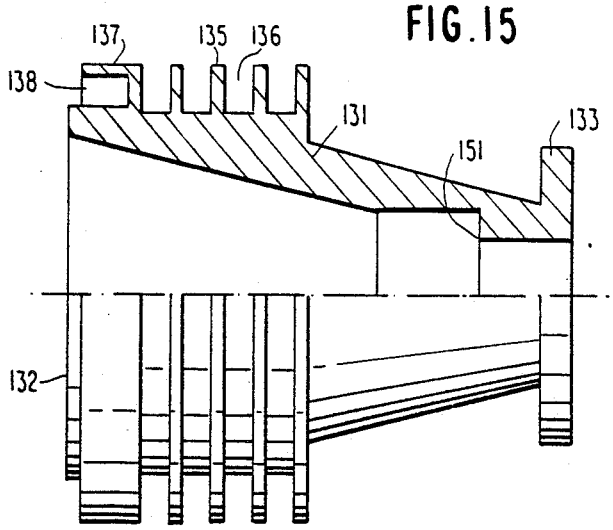
Figure 16:
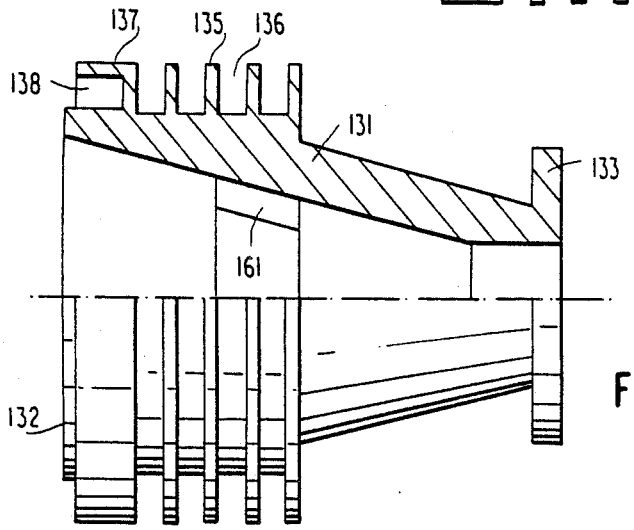

FIGS. 14–16 shows different modifications of the horn antenna of FIGS. 13*a* and 13*b*. Similar parts are represented by the same reference numerals as in FIGS. 13*a* and 13*b*.

Referring to FIG. 14, a so-called flare-iris arrangement is employed for the multimode arrangement. Selection of flare angle $\theta$ and iris 141 can produce a higher mode such as $TM_{11}$ mode wave being in-phase with $TE_{11}$ mode at the horn aperture for a higher frequency wave without generation of any higher modes for a lower frequency wave.

Referring to FIG. 15, a step type arrangement is employed for the multimode horn wherein a higher mode wave is produced at a step portion 151 for a higher frequency wave without generation of any higher modes for a lower frequency wave.

Referring to FIG. 16, a dielectric element loaded type is used for the multimode arrangement wherein a dielectric element 161 is loaded on the inner surface of a flare horn for producing $TM_{11}$ mode for the higher frequency wave.

These horn antennas of FIGS. 14–16 are also used as a primary radiator in a parabolic antenna.

What is claimed is:

1. A horn antenna for radiating or receiving two lower and higher frequency waves, which comprises a multimode horn having an aperture at a front end and a cylindrical outer surface portion at the front side thereof, said multimode horn being formed to produce a dominant mode wave and a higher mode wave for the higher frequency wave so that the dominant mode wave and the higher mode wave are in-phase with each other at said aperture of the horn, said multimode horn being also formed to produce only a dominant mode wave without any higher mode wave for the lower frequency wave, said multimode horn being provided with a choke surface-wave structure on said cylindrical outer surface of said horn, said choke surface-wave structure comprising a plurality of axially spaced conductive radial fins being fixedly mounted on said cylindrical outer surface portion, said conductive fins generally radially extending in parallel with one another and defining annular grooves between adjacent ones on said cylindrical outer surface portion, each annular groove having a depth generally equal to a quarter of a wavelength of the lower frequency wave.

2. A horn antenna as claimed in claim 1, wherein a specific one of said fins which is disposed closest to the horn aperture is provided with an annular flange on the radial outer end thereof, said annular flange axially extending frontwardly from said radial outer end by a distance generally equal to a quarter of the wavelength of the lower frequency wave so that a frontwardly opening axial groove is formed by said specific fin, said annular flange, and said outer surface portion of the horn.

3. A horn antenna as claimed in claim 2, wherein said multimode horn is a multiflare horn.

4. A horn antenna as claimed in claim 2, wherein said multimode horn is a flare-iris horn.

5. A horn antenna as claimed in claim 2, wherein said multimode horn is a step-type horn.

6. A horn antenna as claimed in claim 2, wherein said multimode horn is a dielectric element loaded horn.

7. A parabolic antenna system for radiating or receiving two higher and lower frequency waves, which comprises a parabolic reflector having a focus and a primary radiator positioned at the focus, said primary radiator comprising a multimode horn having an aperture at a front end and cylindrical outer surface portion at the front side thereof, said multimode horn being formed to produce a dominant mode wave and a higher mode wave for the higher frequency wave so that the dominant mode wave and the higher mode wave are in-phase with each other at said aperture of the horn, said multimode horn being also formed to produce only a dominant mode wave without any higher mode wave for the lower frequency wave, said multimode horn being provided with a choke surface-wave structure on said cylindrical outer surface of said horn, said choke surface-wave structure comprising a plurality of axially spaced conductive radial fins being fixedly mounted on said cylindrical outer surface portion, said conductive fins generally radially extending in parallel with one another and defining annular grooves between adjacent ones on said cylindrical outer surface portion, each annular groove having a depth generally equal to a quarter of a wavelength of the lower frequency wave.

* * * * *